US005328089A

United States Patent [19]

Forbes, Jr.

[11] Patent Number: 5,328,089

[45] Date of Patent: Jul. 12, 1994

[54] FRONT LOADED DISPLAY CARTON

[75] Inventor: Hampton E. Forbes, Jr., Newark, Del.

[73] Assignee: Westvaco Corporation, New York, N.Y.

[21] Appl. No.: 1,252

[22] Filed: Jan. 6, 1993

[51] Int. Cl.[5] ..... B65D 25/04; B65D 25/54

[52] U.S. Cl. ..... 229/162; 229/120.18; 229/120.26

[58] Field of Search ..... 229/120.18, 120.24, 229/120.26, 120.29, 162; 206/588

[56] References Cited

U.S. PATENT DOCUMENTS

| | | | |
|---|---|---|---|
| 2,807,404 | 9/1967 | Cote . | |
| 3,563,449 | 2/1971 | Forbes, Jr. | 229/120.18 X |
| 3,682,297 | 8/1972 | Austin et al. | 206/387 |
| 4,034,908 | 7/1977 | Forbes, Jr. et al. | 229/120.18 X |
| 4,113,086 | 9/1978 | Forbes, Jr. . | |
| 4,125,185 | 11/1978 | Bliss | 229/120.18 X |
| 4,134,495 | 1/1979 | Friedman | 229/120.21 X |
| 4,416,412 | 11/1983 | Wischusen, III | 206/588 X |

*Primary Examiner*—Allan N. Shoap
*Assistant Examiner*—Christopher McDonald

[57] ABSTRACT

A front loaded display carton is formed from a one-piece, cut and scored blank of paperboard or the like that is preglued and shipped to the user in a collapsed condition. The carton when squared is of essentially rectangular configuration with a display opening in the front wall and a product containing pocket located interiorly of the carton beneath the display opening. The product containing pocket is formed by internal walls known generally as header panels and stop panels which are cut from the one-piece blank.

8 Claims, 6 Drawing Sheets

FRONT LOADED DISPLAY CARTON

BACKGROUND OF THE INVENTION

The present invention relates generally to an improved display carton of the front loaded type with an interior product containing pocket located beneath a display opening in one wall of the carton. Cartons of this type are generally loaded through one end and are provided with dividers or interior panels for stopping, positioning, retaining and guiding the product as it is loaded in the carton. Examples of such cartons may be found for instance in U.S. Pat. No. 2,807,404 which includes a pair of false interior walls for supporting a product located therein; U.S. Pat. No. 3,682,297 which teaches a pilfer proof carton with interior partition walls; and, U.S. Pat. No. 4,113,086 which discloses stop panels and retaining panels. However, none of the cartons disclosed employ the unique one-piece construction and arrangement of interior panels disclosed herein.

SUMMARY OF THE INVENTION

The present invention relates generally to an improvement in the construction of display-type cartons and more particularly has for its principal purpose the provision of a front loaded carton with a unique interior formed by two glue applications and no more than two or three folding steps. The carton blank of the present invention is cut and scored from a single piece of foldable material (e.g. paper board or the like), and comprises an outer carton structure with a display opening and an integral interior product containing pocket portion for accepting, positioning and retaining a front loaded product. The carton is intended to package small items such as gifts, promotional sizes of larger products, cassette tapes and the like in such a manner that the products are isolated in a protected environment. This objective is achieved in the present invention by the strategic location of header panels and stop panels within the carton structure.

The present invention is carried out by including an extension panel on the blank structure for the carton which is cut and scored to form a first generally U-shaped section which is adhered to the interior of one wall of the carton and a second generally T-shaped section which is adhered to the interior of another wall of the carton. These sections are spaced from one another by strategically located header and stop panels for locating the product in the product containing pocket interiorly of the carton. Meanwhile one wall of the carton, preferably the top or front wall, is provided with a display opening located over the product pocket so that the carton can be loaded from the front. The loaded product is retained in its pocket by the header panels and stop panels, and by product retaining tabs located on the inner edges of the display opening.

DETAILED DESCRIPTION

Figure 1:
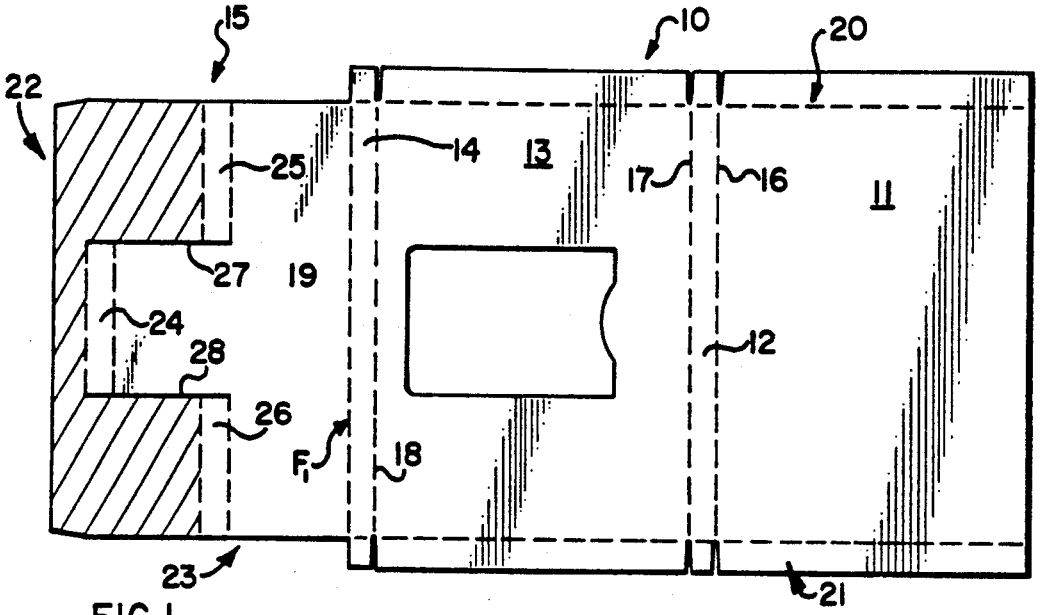
FIG. 1 is a plan view of a blank for making a first embodiment of the carton of the present invention.

Referring now to FIG. 1 of the drawing, a typical carton blank 10 will be seen to comprise in sequence a rear panel 11, first side wall 12, a front panel 13, a second side wall 14 and an extension panel 15 connected together by parallel spaced apart scored lines 16–19. Panels 11–14 with the end closure flaps 20 and 21 located at the ends thereof constitute the outer structure of the carton of the present invention while the extension panel 15 forms the interior compartment of the carton. Extension panel 15 is divided by cut and scored lines to provide a first generally U-shaped section 22 and a generally T-shaped section 23. These sections are separated from one another by spacer panels 24, 25 and 26 formed by separate, parallel scored lines and a pair of cut lines 27, 28. As shown in FIG. 1, the extension panel 15 is cut and scored symmetrically to provided a centrally located pocket that is located beneath a cut-out 29 provided in the front panel 13. One or more product retaining tabs 30 are provided along the inner edges of the cut-out 29 which extend into the cut-out area for retaining products in the product pocket. It will be understood that the product pocket and cut-out may be shifted away from the center of the carton merely by relocating the cut lines 27, 28 and cut-out 29.

Figure 2:
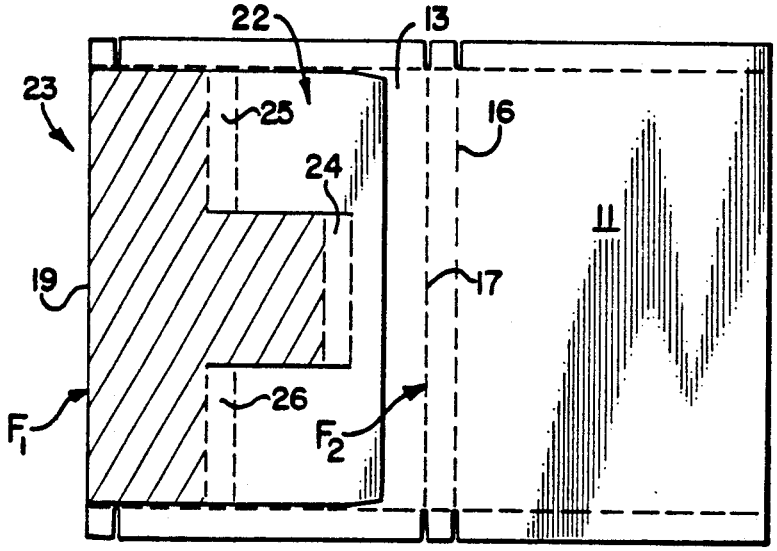
FIG. 2 illustrates the blank of FIG. 1 after the first folding step.
Figure 3:
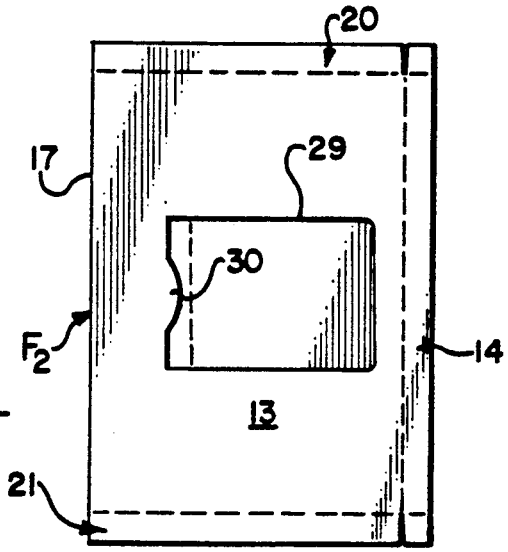
FIG. 3 shows the blank completely folded to form the carton in its collapsed condition.

When the carton blank 10 of FIG. 1 is prepared for forming into its carton configuration, adhesive is applied to the U-shaped section 22. The extension panel 15 is then folded at $F_1$ along scored line 19 to adhere the U-shaped section 22 to the inside of front panel 13. Adhesive is also applied to the T-shaped section 23 before folding the blank at $F_2$ along scored line 17 to adhere the T-shaped section 23 to the inside of rear panel 11. The adhesive applications may take place simultaneously or in steps, depending upon the type of equipment used to form the carton. FIG. 2 shows the blank structure after the first folding step $F_1$ and FIG. 3 shows the blank structure after the second folding step $F_2$. The carton is fully formed but in its collapsed condition for shipment to the user in FIG. 3. While not shown in the drawing, it will be understood that the extension panel 15 may require pre-breaker scores for the spacer panels 24, 25 and 26 as well known in the art.

Figure 4:
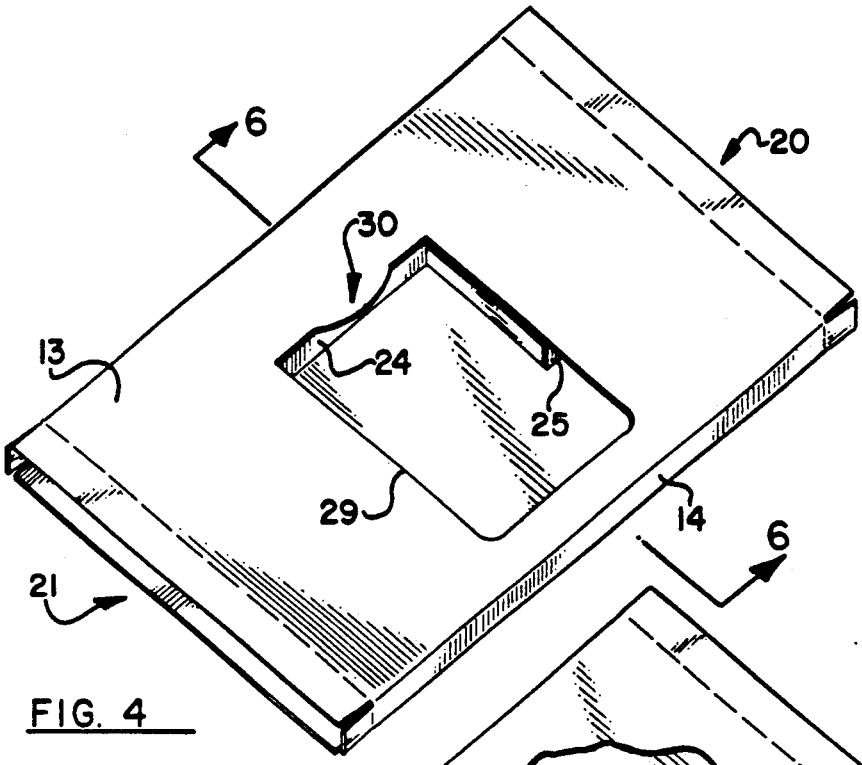
FIG. 4 is a perspective view of the carton of FIG. 3 in its set-up condition.
Figure 5:
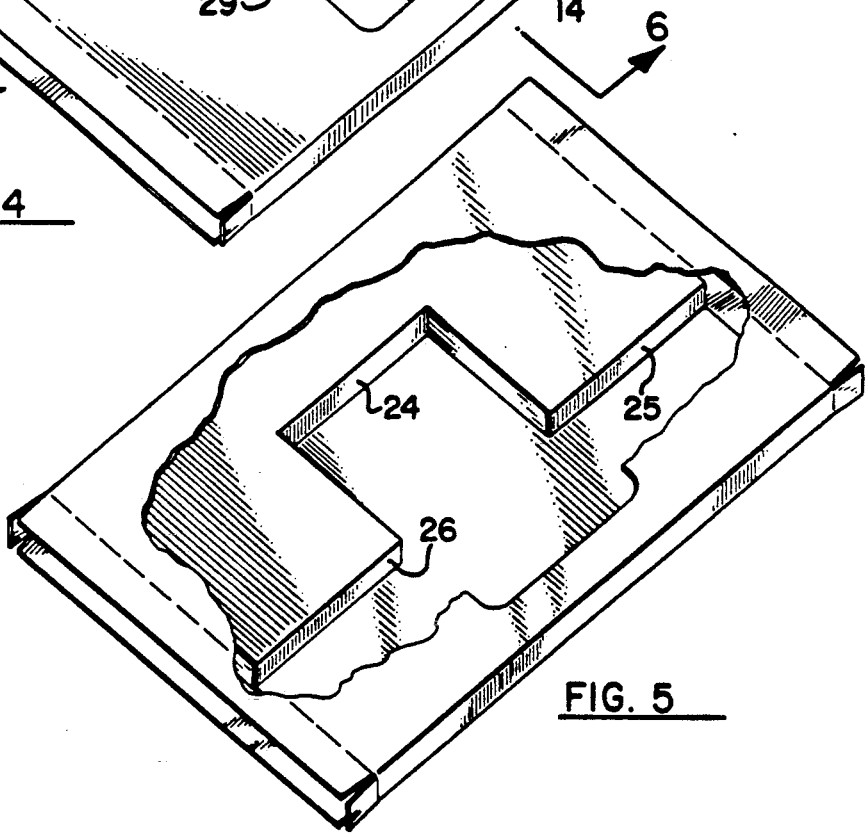
FIG. 5 is a perspective view of the carton of FIG. 4 with its top panel partially cut away to show the product-containing interior compartment.
Figure 6:
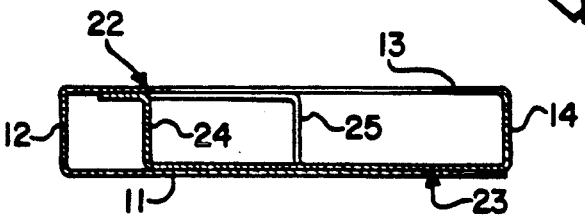
FIG. 6 is a cross sectional view taken along the lines 6—6 of FIG. 5.

When the carton is squared as shown in FIG. 4, the end closure flaps 20, 21 are folded and adhered together so that the carton is ready for loading. The structure is of the front loading type where the product is inserted into the cut-out 29 provided in front wall 13 and secured behind the product retaining tab 30 (only one shown). The loaded carton may then be overwrapped if desired. FIGS. 5 and 6 illustrate details of the inner product containing pocket of the carton. In the embodiment shown in FIGS. 1–6, panel 24 is generally referred to as a header panel while panels 25 and 26 are referred to generally as stop panels. These panels keep the product properly located beneath the cut-out 29 in top panel 13. In particular, FIG. 6 illustrates the spacial location of the header panel 24 and one of the stop panels 26.

The forming of the carton as described hereinbefore in substantially conventional, and is accomplished mechanically on suitably programmed folding and gluing machinery. The application of compressive force to the folded blank after each folding step tends to aid the set of the adhesive and to maintain the carton in its preferred collapsed condition for shipment to the ultimate user. The generally U-shaped and T-shaped sections of the extension panel 15 are shown shaded for contrast and to proved clarity to the inventive concept. Adhesive is not generally applied to the complete shaded areas shown but only to portions thereof to achieve the full effect of the present invention.

A second embodiment of the invention is shown in FIGS. 7–12. For this embodiment, the blank 40 comprises in sequence a front panel 41, first side wall 42, a rear panel 43, a second side wall 44 and an extension panel 45, connected together by parallel, spaced part scored lines 46-49. As in the case of the embodiment disclosed in FIGS. 1–6, panels 41–44 with the end closure flaps 50 and 51 located at the ends thereof constitute the outer structure of the carton while the extension panel 45 forms the interior product containing pocket of the carton. Extension panel 45 is divided by cut and scored lines to provide a first generally U-shaped section 52 and a T-shaped section 53. Like the previous embodiment, these sections are separated from one another by spacer panels 54, 55, 56 formed by separate parallel scored lines and a pair of cut lines 57, 58. Also, as in the previous embodiment, front panel 41 includes a product display cut-out 59 with at least one product retaining tab 60.

Figure 7:
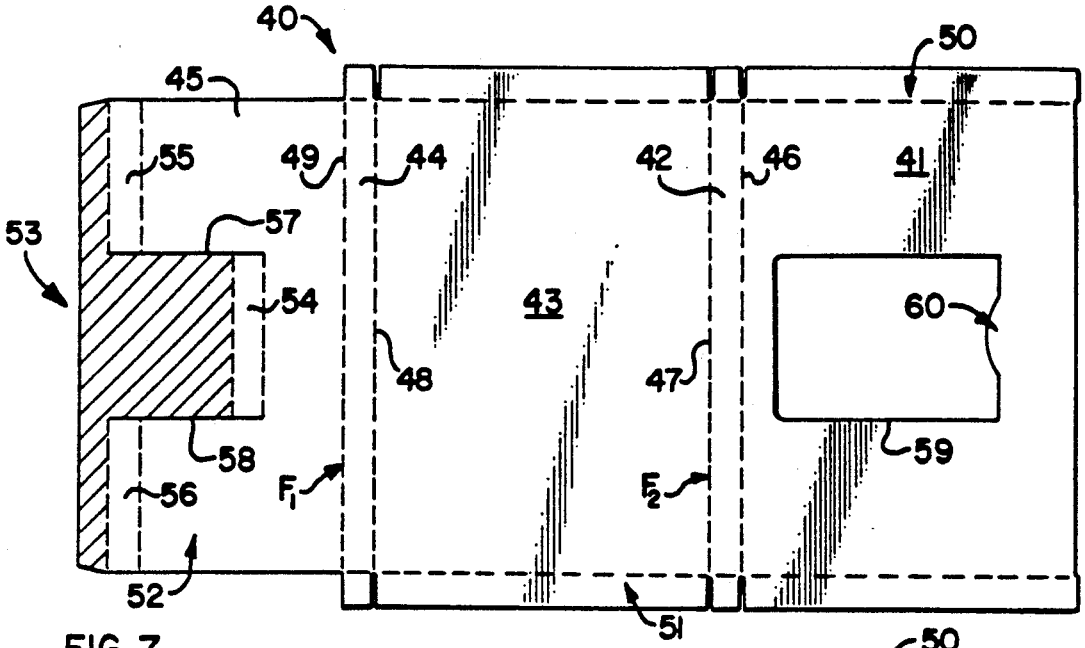
FIG. 7 is a plan view of a blank for making a second embodiment of the carton of the present invention.
Figure 8:
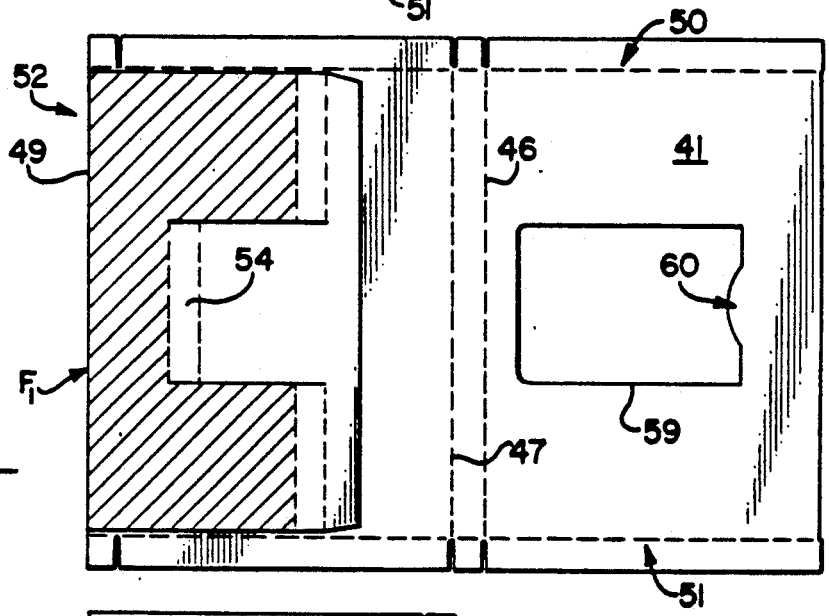
FIG. 8 illustrates the blank of FIG. 7 after the first folding step.
Figure 9:
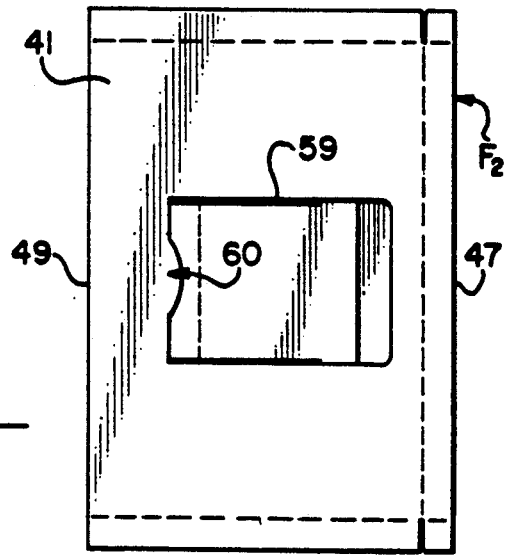
FIG. 9 shows the blank completely folded to form the carton in its collapsed condition.

When the carton blank 40 of FIG. 7 is prepared for folding into its carton configuration as shown in FIGS. 8 and 9, adhesive is applied to the T-shaped section 53 prior to the first folding step $F_1$ along scored line 49. Adhesive is also applied to the U-shaped section 52 before the second folding step $F_2$ along scored line 47. FIG. 8 shows the blank 40 after the first folding step $F_1$ and FIG. 9 illustrates the carton in its fully formed, collapsed condition after the second folding step $F_2$.

Figure 10:
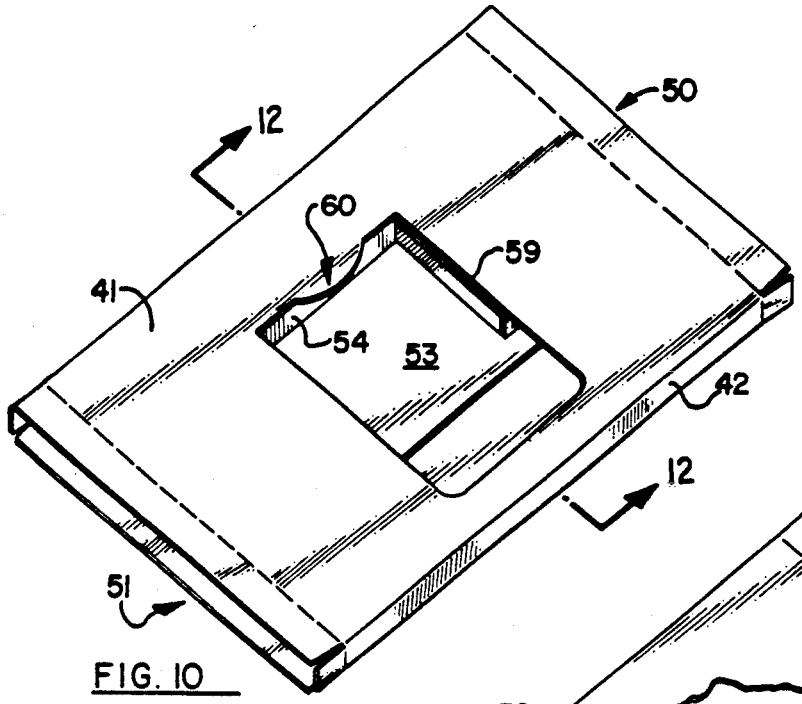
FIG. 10 is a perspective view of the carton of FIG. 9 in its set-up condition.
Figure 11:
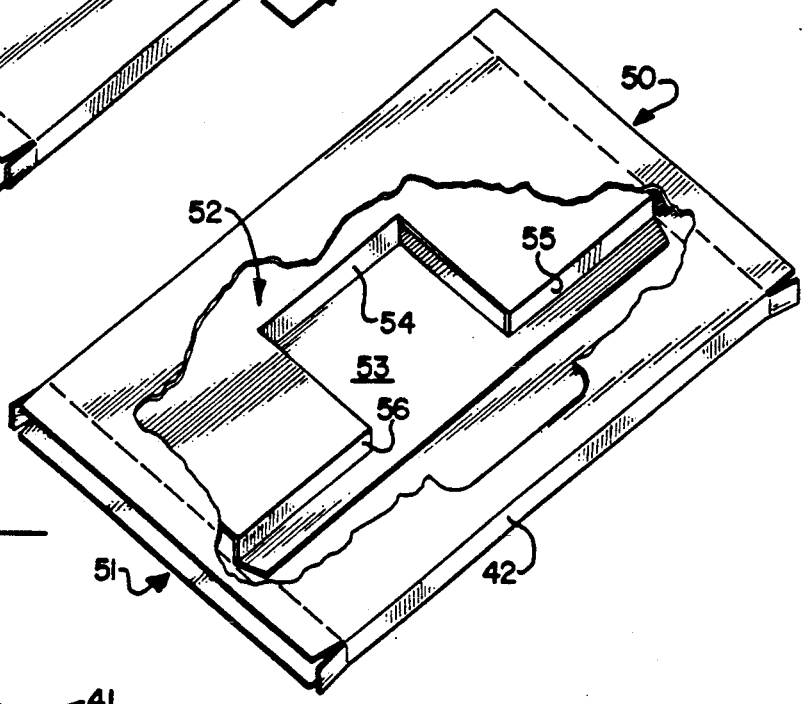
FIG. 11 is a perspective view of the carton of FIG. 10 with its top panel partially cut away to show the product-containing interior compartment.
Figure 12:
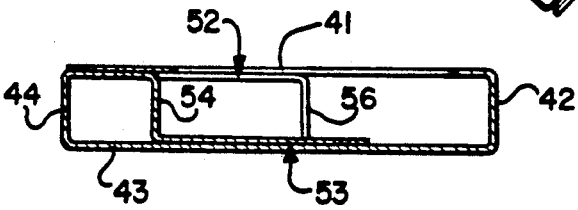
FIG. 12 is a cross sectional view taken along the lines 12—12 of FIG. 11.

When the carton is squared as shown in FIG. 10, the end closure flaps 50, 51 may be closed for preparing the carton for loading. FIGS. 11 and 12 illustrate details of the inner product containing pocket of the carton. In particular, the pocket is formed by the header panel 54 and the two product stop panels 55, 56. The generally U-shaped section 52 is adhered to the inside of top panel 41 and the generally T-shaped section 53 is adhered to the bottom panel 43. The same features and alternatives described hereinbefore for the first embodiment also apply to this second embodiment.

A third embodiment of the present invention is shown in detail in FIGS. 13-18. For this embodiment, the blank 70 comprises in sequence a front panel 71, first side wall panel 72, rear or bottom panel 73, second side wall panel 74 and an extension panel 75 connected together by parallel, spaced apart scored lines 76-79. Panels 71-74 in conjunction with the end flaps 80, 81 form the outer structure of the carton of the third embodiment while the extension panel 75 is designed to provide a product retaining pocket. Extension panel 75 is divided by cut and scored lines to yield a generally U-shaped section 82 (shown in FIG. 14) and a generally T-shaped section 83 shown in FIG. 13. These sections are separated from one another in this embodiment by spacer panels 84, 85, 86 and 87 formed by separate parallel score lines and cut lines, or in the illustrated embodiment, narrow cut-outs 88 and 89. Cut-outs 88, 89 are shown only to provide a slightly staggered relationship between the spacer panels to accommodate a specific product. Also, as in the previous two embodiments, the front panel 71 includes a product display cut-out 90 with at least two product retaining tabs 91.

Figure 13:
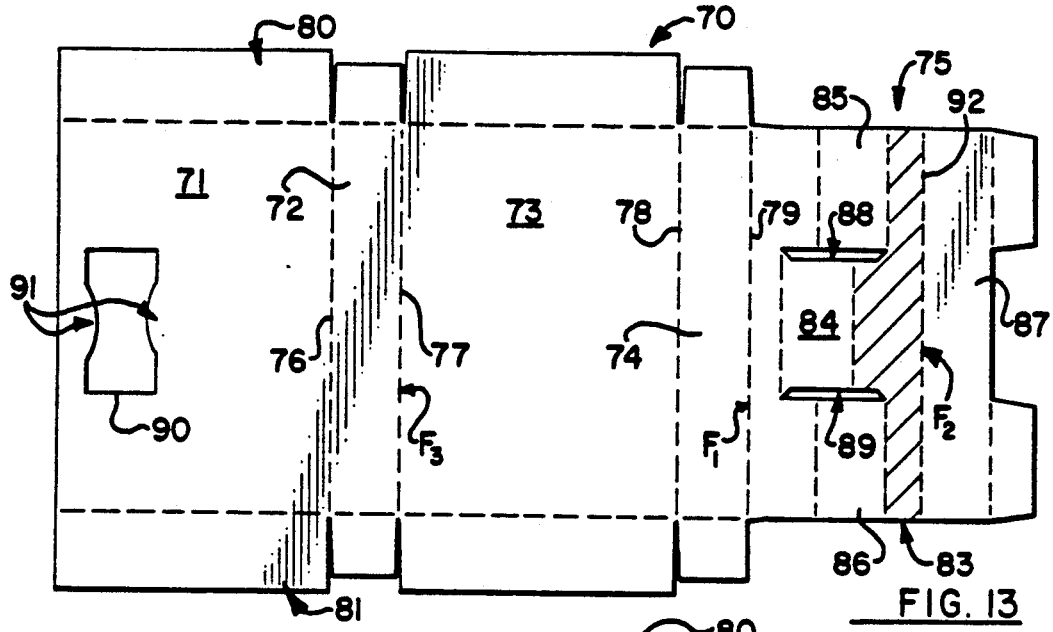
FIG. 13 is a plan view of a blank for making a third embodiment of the carton of the present invention.
Figure 14:
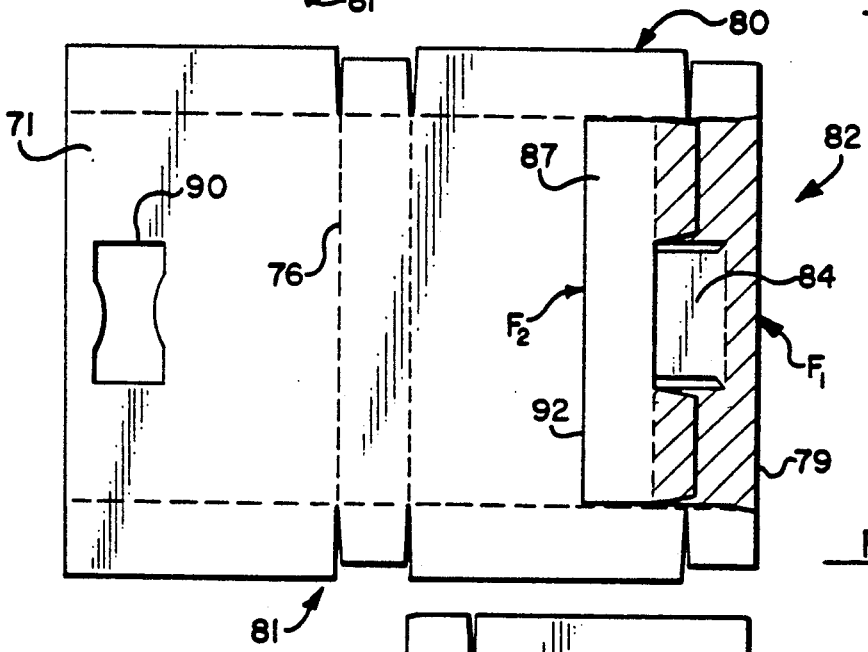
FIG. 14 illustrates the blank of FIG. 13 after the first and second folding steps.
Figure 15:
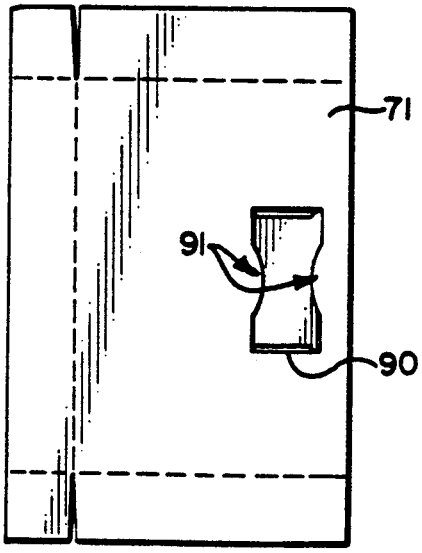
FIG. 15 shows the blank completely folded to form the carton in collapsed condition.

When the carton blank 70 of FIG. 13 is prepared for folding into its carton configuration, as shown in FIGS. 14 and 15, adhesive is applied to the T-shaped section 83 of extension panel 75 prior to the first folding step $F_1$ along scored line 79. At that point, the T-shaped section 83 is adhered to the inside of rear wall 73. Next, the second folding step $F_2$ is carried out along scored line 92, as shown in FIG. 14, where adhesive is applied to the U-shaped section 82 of extension panel 75. At this point, the blank is folded along score line 77 to carryout folding step $F_3$ which adheres the U-shaped section 82 to the inside of front wall 71 and fully forms the carton in its collapsed condition as shown in FIG. 15.

Figure 16:
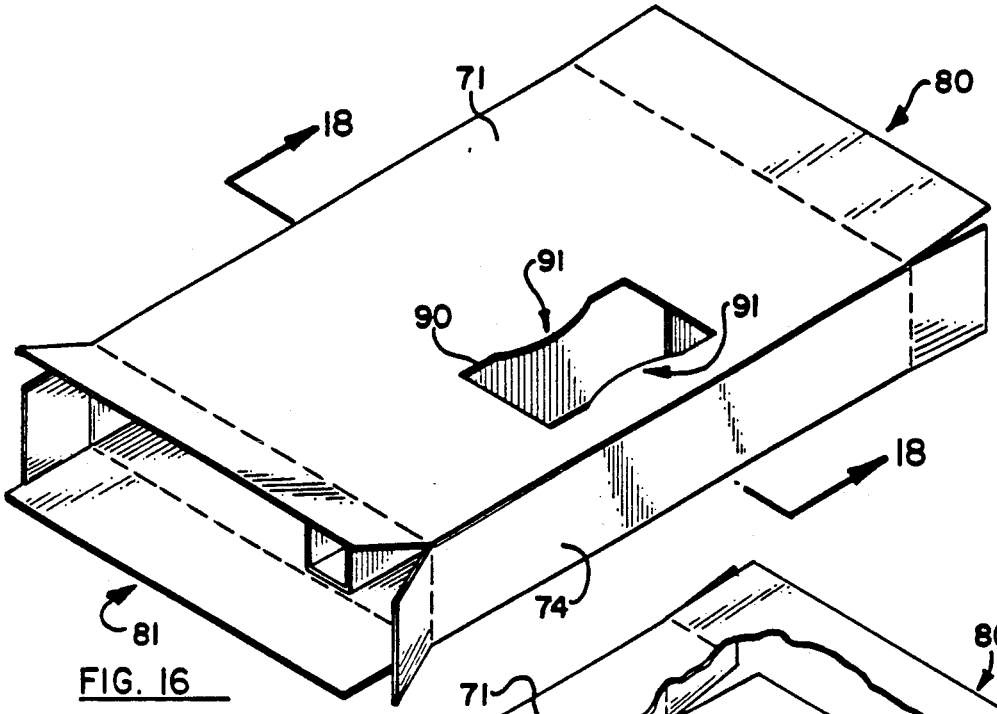
FIG. 16 is a perspective view of the carton of FIG. 15 in its set-up condition.
Figure 17:
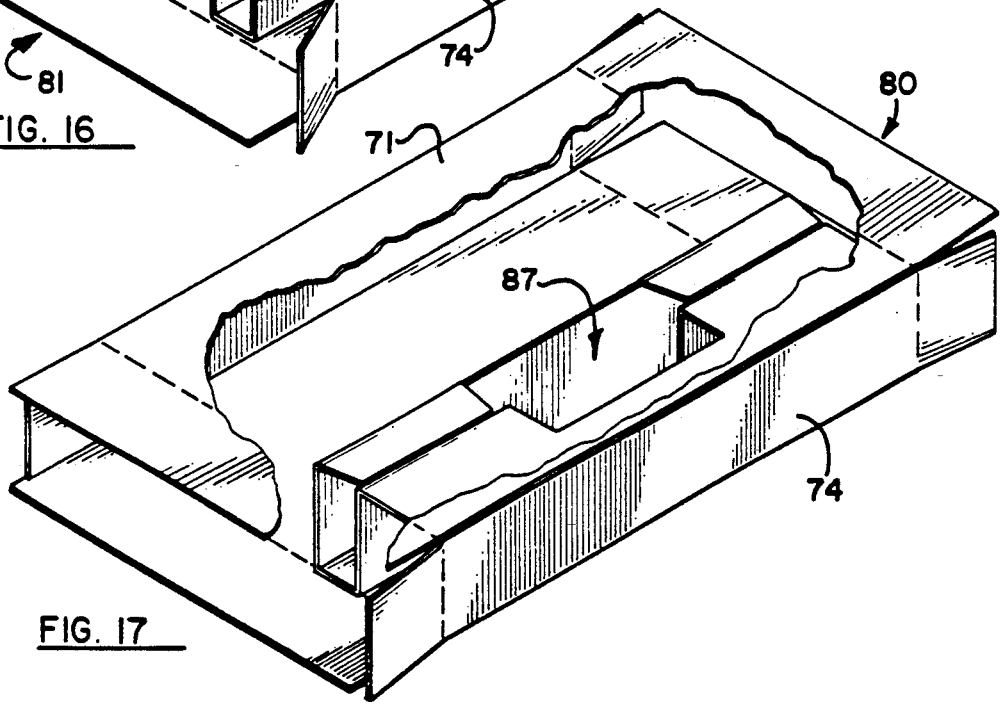
FIG. 17 is a perspective view of the carton of FIG. 16 with its top panel partially cut away to show the product-containing interior compartment; and, FIG. 18 is a cross sectional view taken along the lines 18—18 of FIG. 17.
Figure 18:
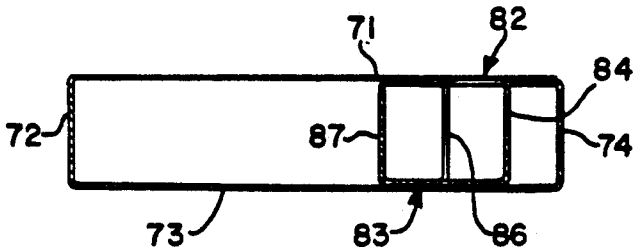

When the carton is squared as shown in FIG. 16, the end closure flaps 80, 81 may be closed to complete the carton and prepare it for loading. FIGS. 17 and 18 illustrate details of the inner product pocket of the carton. In particular, the pocket is formed by header panels 84 and 87 and the product stop panels 85, 86° The generally U-shaped section 82 of the extension panel 75 is adhered to the inside of the front panel 71 and the generally T-shaped section 83 is adhered to the inside of bottom panel 73 as in the prior embodiments. As in the case of the prior embodiments, it will be understood that the product pocket and display cutout 90 may be readily relocated within the carton as desired.

It may thus be seen that the present invention provides an improved collapsible display carton with a display opening located over a product containing pocket which is easy to manufacture, assemble and erect. The carton of the present invention is economical of material used, economical of labor to produce, and fully protects and isolates the packaged product. The specification and the accompanying drawing have described and illustrated several embodiments of the invention, each of which incorporate a common theme of using a cut and scored extension panel with generally U-shaped and T-shaped glued sections which produce the novel product containing pocket. However, even though these preferred embodiments have been described in detail, it will be apparent to those skilled in the art that changes and variations may be made in the construction of the carton within the scope of the invention as defined in the appended claims.

What is claimed is:

1. A collapsible front loaded display carton having opposed, front and rear panels of substantially equal length joined to opposed side wall panels of substantially equal length, said panels being arranged in the form of a sleeve with end closure flaps foldably attached to each end, a window opening cut from said front panel and an extension panel attached to one of said sidewall panels, said extension panel being secured interiorly of the carton to form a product capturing pocket beneath the front panel window, said extension panel being cut and scored to provide a T-shaped section the entirety of which is adhered to the interior of one of said front or rear panels and a U-shaped section the entirety of which is adhered to the interior of one of said front or rear panels.

2. The carton of claim 1 wherein the T-shaped section is arranged substantially symmetrically within the U-shaped section of said extension panel.

3. The carton of claim 2 wherein the T-shaped section is spaced from the U-shaped section by at least one pair of stop panels and at least one header panel, said stop panels being spaced from one another by a distance substantially equal to the length of said header panel, and located one at each side of the product pocket.

4. The carton of claim 3 wherein the stop panels and header panels are all of the same height so that the T-shaped section is spaced equi-distantly from the U-shaped section when the carton is squared into its sleeve configuration.

5. The carton of claim 4 wherein the header panel forms at least one wall of the product containing pocket and a side wall of the carton forms the opposite wall of the product containing pocket.

6. A collapsible front loaded display carton prepared from a folded blank of paperboard comprising front and rear panels joined by opposing side walls, end closure flaps attached to the ends of said front and rear panels and side walls, a display opening cut from said front panel and an extension panel foldably attached to one of said side walls and adapted to form an interior pocket beneath said display opening when the carton is erected, said extension panel being cut and scored to provide a U-shaped section the entirety of which is adhered to the interior of said front panel, a T-shaped section the entirety of which is adhered to the interior of said rear panel and a pair of product stop panels and a header panel separating said U and T-shaped sections form one another when the carton is erected.

7. The carton of claim 6 wherein one or more product retaining tabs are included along the inner edges of said display opening.

8. The carton of claim 7 wherein the product stop panels and header panel are all of the same height and are located on adjacent sides of the product pocket within the interior of the carton.

* * * * *